United States Patent [19]

Berndt et al.

[11] 4,263,120

[45] Apr. 21, 1981

[54] ELECTROLYTIC CELL FOR THE RECOVERY OF NONFERROUS METALS AND IMPROVED ANODE THEREFOR

[75] Inventors: Gerhard Berndt, Seevetal; Adalbert Bartsch, Marxen; Olaf Kölln, Hamburg, all of Fed. Rep. of Germany

[73] Assignee: Norddeutsche Affinerie, Hamburg, Fed. Rep. of Germany

[21] Appl. No.: 88,123

[22] Filed: Oct. 25, 1979

[30] Foreign Application Priority Data

Oct. 26, 1978 [DE] Fed. Rep. of Germany ..... 2846692

[51] Int. Cl.[3] ..... C25C 7/00; C25C 7/02

[52] U.S. Cl. ..... 204/273; 204/277; 204/288

[58] Field of Search ..... 204/105 R, 106, 277–278, 204/273, 270, 280, 286–288

[56] References Cited

U.S. PATENT DOCUMENTS

| | | | |
|---|---|---|---|
| 1,278,308 | 9/1918 | Cullen | 204/277 X |
| 1,365,032 | 1/1921 | Greenawalt | 204/277 X |
| 1,565,216 | 12/1925 | Smith | 204/273 X |
| 1,700,178 | 1/1929 | Porzel | 204/277 X |
| 2,615,840 | 10/1952 | Chapman | 204/277 X |
| 2,675,348 | 4/1954 | Greenspan | 204/277 X |
| 4,113,586 | 9/1978 | Cook et al. | 204/105 R |

OTHER PUBLICATIONS

Gianelos, L., "Air Agitation Systems", *Plating and Surface Finishing*, vol. 65, No. 3, (Mar. 1978).

*Primary Examiner*—G. L. Kaplan
*Assistant Examiner*—D. R. Valentine
*Attorney, Agent, or Firm*—Karl F. Ross

[57] ABSTRACT

An anode for a cell for electrolytic recovery of nonferrous metals especially copper is provided with a plate-shaped deposition surface, a hanger for suspending the anode in the cell, and a perforated pipe along a bottom edge of the anode for discharging bubbles of gas upwardly in the electrolyte along the faces of the anode. A bar along an edge of the anode can be provided with a feeder for the gas communicating with the pipe and the hanger may have a passage communicating with this feeder.

10 Claims, 5 Drawing Figures

Fig.3
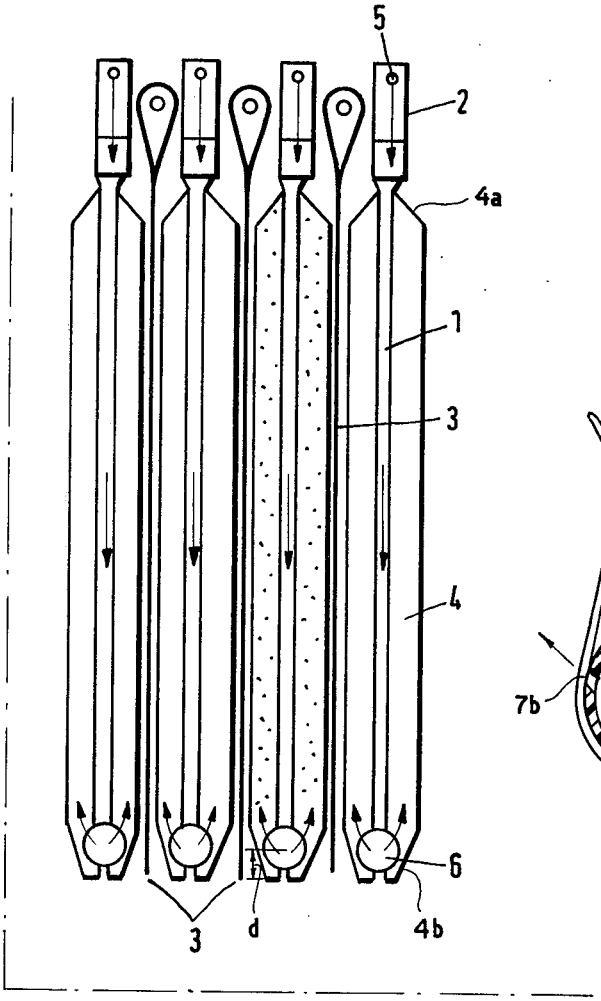
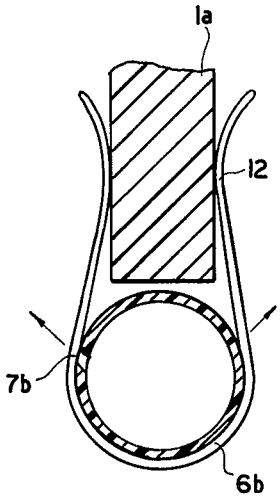
FIG.4
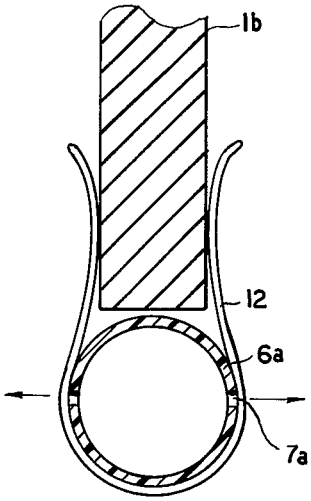
FIG.5

ELECTROLYTIC CELL FOR THE RECOVERY OF NONFERROUS METALS AND IMPROVED ANODE THEREFOR

FIELD OF THE INVENTION

Our present invention relates to the electrolytic refining or recovery of nonferrous metals whereby the nonferrous metal, usually cooper, is deposited from an electrolyte solution upon a cathode juxtaposed with an anode. More particularly, the invention relates to improvements in electrodeposition cells and especially the anodes of such cells.

BACKGROUND OF THE INVENTION

In the electrolytic refining or recovery of nonferrous metals such as copper, i.e. so-called winning and electro-deposition, the nonferrous metal is deposited from an electrolyte solution containing salts thereof upon a cathode which is spacedly juxtaposed with an anode in the electrolytic cell. Both the anode and the cathode are commonly oriented vertically and, for example, may be supported by hangers or the like at their upper ends. The cathode may be composed of the metal to be refined, or an inert material, while the anode may be an inert plate.

Because of the electrochemical nature of the deposition operation, various phenomena which are familiar in electrolyte systems and at electrode-electrolyte interfaces arise, including concentration gradients from top to bottom in the electrolyte, conductivity gradients, polarization, ion contamination etc.

Thus it has been recognized that some degree of relative movement of the electrode and the electrolyte of the cell is advantageous to improve the efficiency from the energy or metal-deposition viewpoint.

For example, nonferrous metals are usually for electrolytic recovery from electrolyte solution containing the metal in low concentrations. The circulation of the electrolyte can result in an equalization of the concentration over the entire surface of the anode and within the cell so that a depletion of the nonferrous metal in the cathode region does not result in premature evolution of hydrogen, thereby decreasing the electrical current efficiency and resulting in the formation of poor, nonhomogeneous (spony) deposits of metal.

Numerous techniques have been used to agitate or displace the electrolyte relative to the electrodes of the cells. For example, the electrolyte may be circulated or pumped past the electrode surface at greater or lesser speeds, may be induced to rise and lower by the application of gas pressure or displacement forces, may be agitated or stirred by stirring devices in contact with the electrolyte, and even may be displaced by movement of one or more electrodes. The simple movement of the electrodes may itself serve to bring about the relative displacement or combinations of these techniques may be employed.

For the most part, however, efforts have concentrated on high velocity pumping of the electrolyte between the electrodes (*see Ullmann's Encycklopadie der technischen Chemie,* 4th Edition, Vol. 3, p. 268; V. Tafel: *Lehrbuch der Metallhuttenkunde,* Vol. 1, p. 552, 1951; *Die technische Elektrometallurgie wasseriger Losungen,* Part I, Akademisch Verlagsgesellschaft Geest & Portig K.-G., p. 129, Leipzig, 1961).

A disadvantage of this system is that efficient relative displacement of the electrode and the electrolyte requires the creation of turbulence at the interface and, with the usual cell dimensions, the pumping of the electrolyte does not meet the criteria for developing such turbulence. Efforts to alter the cell dimensions to ensure turbulence have been found to diminish the access of the electrolyte to the electrodes. Consequently, the pumping technique by mass displacement of the electrolyte is not sufficiently effective and is not efficient for the purposes.

It has also been proposed to effect the relative displacement of the electrolyte and the electrodes and/or agitation of the electrolyte by so-called gas-lift techniques whereby a gas is introduced into the electrolyte at the bottom of the cell and gas bubbles rise in the electrolyte for agitation and entrainment purposes.

For example, in British Pat. No. 1,392,705, a system is described in which the gas is discharged from a pipe system disposed at the bottom of the cell. U.S. Pat. No. 3,959,112 describes a similar arrangement in which the gas discharge pipes are porous so that the bubbles rise in a fine curtain. Other systems in which pipes are mounted or provided at the bottom of the cell are found in U.S. Pat. 3,928,152 and German patent document (Open Application—Offenlegungsschrift) No. 2,508,094.

While upwardly moving gas bubbles are effective to bring about the desired agitation of the electrolyte, problems have been encountered with the earlier systems described. For example, it is difficult, because the pipe systems are located at the bottom of the cell, to readily clean the latter. Furthermore, the air-bubbling arrangements tend to become encrusted or covered by cell precipitates or sediment during cell operation, the sediments or encrustations tending to block the introduction of air into the electrolyte.

OBJECTS OF THE INVENTION

It is the principal object of the present invention to provide an electrolytic cell especially for the electrowinning or electrodeposition of nonferrous metals upon cell electrodes, whereby the disadvantages of the earlier systems, as described, can be obviated.

Another object of the invention is to provide an improved anode for a cell for the recovery by electrodeposition of nonferrous metals.

SUMMARY OF THE INVENTION

These objects and others which will become apparent hereinafter are attained, in accordance with the present invention, with an improved anode (and hence an electrodeposition cell containing the same) in which the anode comprises a plate or flat conductive substrate adapted to be immersed in an electrolyte containing the nonferrous metal, supported from the usual hanger bar, and provided along its bottom edge with a pipe which distributes air into the electrolyte and which is preferably perforated although it may be composed of porous material, e.g. an air-permeable sintered material.

According to the invention, along at least one vertical longitudinal edge of this plate, a feeder passage is provided which extends upwardly from and communicates with this pipe for connection to a source of gas under pressure. This feeder can, in turn, communicate with a passage formed in the hanger and provided at one end of the hanger with a quick-connect coupling for connection of the gas system of the anode to a manifold running along the cell above the electrode and connected in turn to a source of the gas under pressure. The feeder can be a bar removably affixed to the plate or simply lying along a vertical edge thereof and connected to the hanger bar while the pipe can be connected to the feeder at one end and to a support bar along the opposite edge of the plate. Alternatively, it can be removably connected to the plate itself.

According to another aspect of the invention, an electrolytic cell for electrowinning or electrodeposition of a nonferrous metal which comprises a vessel containing the electrolyte and supports for the anodes and cathodes that preferably are spaced apart and disposed alternatingly across the cell, the electrodes being supported by the usual hangers. In this case, a plurality of anodes in accordance with the present invention are provided, spaced from interposed cathodes and are supplied by a common manifold with the gas under pressure.

According to a further feature of the invention, the connector between the gas-supply manifold and each anode consists of a quick-connecting coupling, which may be connected by an elastic connector to the gas supply conduit.

To facilitate the detaching and fixing of the tube mounted on the underside of the anode, a preferred feature resides in that the tube is connected to the gas feeder by a socket fitting, e.g. a bayonet coupling.

To preclude mechanical or electrical contact between the anode and the adjacent cathode, the anode is provided with non-conducting bars or bar elements, which embrace the longitudinal sides of the anode, and one of the bars is used to secure the gas feeder to the anode.

The lateral bars can be provided with means for holding the tube and may have such a dimension at right angles to the surface of the anode that the bars serve as spacers holding the anode apart from the adjacent cathode.

The spacer is used to prevent the distance between the anode and cathode from decreasing below a lower limit but the cathode need not engage the bar in the operation of the electrolytic cell.

The thickness of the entire bar projecting on both sides is about 25 to 30 mm. To facilitate the removal and insertion of the cathodes, a gap of about 10 to 15 mm should be maintained between the bars of adjacent anodes.

The gas may be discharged into the interelectrode spaces from the horizontal tube through gas outlet bores in any desired positions. A particularly effective electrolyte circulation is obtained if the axes of the gas outlet bores in the tube extend horizontally or are upwardly inclined with regard to the anode surface.

To facilitate the insertion of the cathodes into the electrolytic cell which has previously been provided with anodes as well as the replacement of individual anodes, the bars which embrace the anodes are preferably tapered at the upper and lower ends.

The gas feeder extending along the longitudinal side of the anode consists preferably of a tube made of the same material as the anode. The same applies to the socket fitting which receives the tube provided with gas outlet openings. The gas feeder is firmly joined to the anode, e.g. by welding.

The tube provided with gas outlet openings is made of a synthetic resin material, such as rigid polyvinylchloride. This precludes formation of crusts resulting from entrance of gas into crystallizable electrolyte adjacent to the gas outlet openings, and excludes disturbances which are due to such crusts.

The gas outlet openings have a diameter of the order of 0.8 mm and are spaced apart by about 50 to 70 mm. An adequate supply of gas can be effected if the gas is supplied with a superatmospheric pressure of 0.2 to 0.5 bar.

When the electrodes are being installed into an electrolytic cell, care should be taken that the cathode protrudes downwardly from the anode. To avoid a scattering adjacent to the tube provided with gas outlet openings, the cathode should protrude to such an extent that the emerging gas does not flow below the cathode. It is generally sufficient to extend the cathode 20 to 30 mm below the line of the gas outlet openings.

The gas to be supplied to the electrolytic cell is advantageously preheated to the electrolyte temperature and saturated with water vapor. This is preferably effected before the gas enters the gas supply conduit. By this measure, the risk of a crystallization of solutes in the electrolyte near the gas outlet openings is substantially eliminated.

The most important advantages afforded by the invention reside in that complicated internal fixtures in the cells or specific cell designs are not required but existing electrolytic cells can be altered without difficulty. Besides, the handling in use and the maintenance are economical and simple and the movement of the electrodes in the cell for purposes of emptying, cleaning or repairing is not obstructed by complicated internal structures which are likely to break. When the tube provided with gas outlet openings becomes clogged, it can easily be removed and can be replaced, if required. The high specific current density of about 400 to 600 $A/m^2$ which may be used, the high quality of the cathode metal, the compact design, the high efficiency and the simple handling in use combine to result in a decisive increase of the economy of the electrolytic process. Another advantage resides in that when new electrodes are installed at the end of a run the positions of the cathodes and anodes can be changed without obstruction by separate gas discharge means.

BRIEF DESCRIPTION OF THE DRAWING

In the drawing:

FIG. 3 is a diagram showing a set of electrodes consisting of a plurality of anodes and cathodes; and FIGS. 4 and 5 are cross-sectional views through perforated tubes along the lower edge of anode plates according to the invention, showing preferred orientations of the perforations.

SPECIFIC DESCRIPTION

Figure 1:
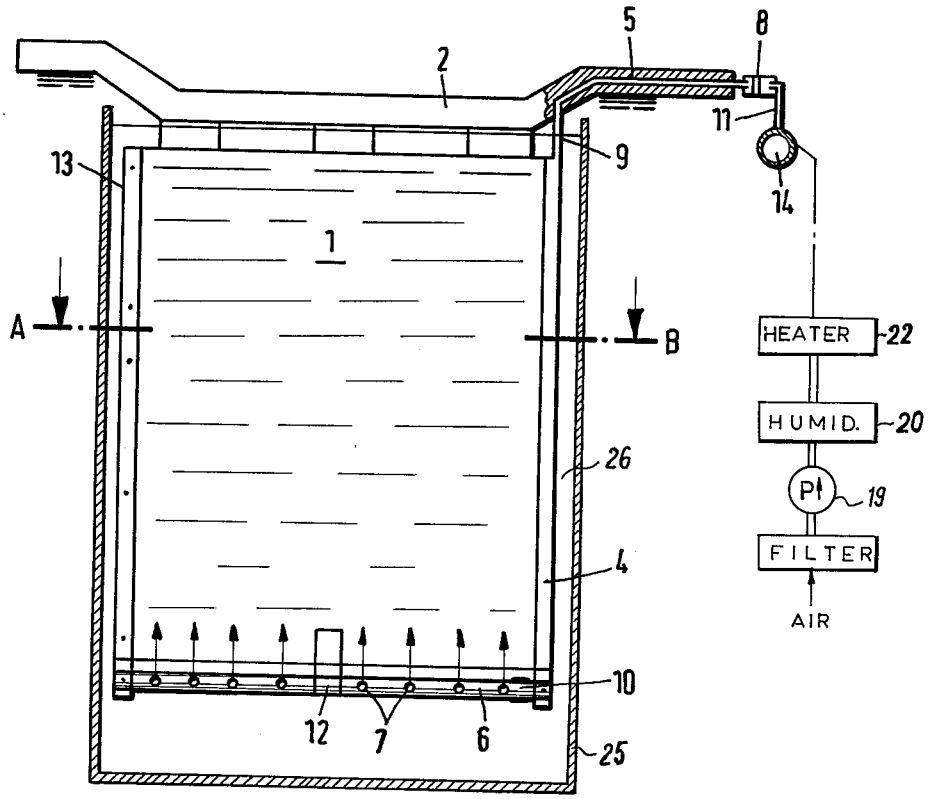
FIG. 1 is a front elevational view showing the anode according to the invention.

In the arrangement shown in FIG. 1, the anode 1 is provided with a carrying rod 2, which has at one end a bore 5. The bore 5 extends in the axis of the carrying rod 2 as far as to the outer edge line of the anode 1 and thereafter extends vertically downwardly.

Both ends of the bore 5 are provided with soldered or screw-connected tubular nipples for receiving the quick-connecting coupling 8 at one end and for connection to the gas feeder 9 at the other end.

A tube 6 provided with gas outlet openings 7 is provided at the lower edge of the anode 1 and is connected to the gas feeder 9 by a socket fitting 10. The tube 6 is additionally secured by the holder 12.

Figure 2:
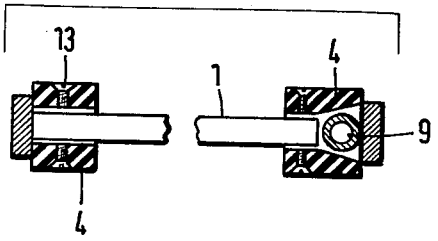
FIG. 2 is a transverse sectional view taken along line A–B in FIG. 1.

Two bars 4 are connected to the anode 1 by screws 13 (see particularly FIG. 2). It is also apparent from FIG. 2 that the bars 4 serve as spacers and enclose the gas feeder 9 and electrically insulate the anode edges.

In the operation of the anode according to the invention, the gas, consisting mostly of air (e.g. from a compressor 19), is saturated in a humidifier 20 and heated to the electrolyte temperature in a heater 21 and is then supplied via the gas supply conduit or manifold 14, which extends freely along the electrolytic cell, the elastic connection 11 and the fitting 8.

The gas flows then in the vertical gas feeder 9, which extends downwardly along the longitudinal edge of the anode, to the socket fitting 10 at the lower portion of the anode and then enters the tube 6 and is discharged into the electrolyte through the gas outlet openings 7.

Four anodes 1 and three cathodes 3 are shown in FIG. 3. The additional reference characters designate elements of construction mentioned with respect to FIGS. 1 and 2. FIG. 3 shows streams of bubbles in two interelectrode spaces and indicates also the extent of the cathode 3 relative to the tube 6. The cell housing is shown at 25 and the electrolyte at 26. The upper and lower ends of the bars 4 are tapered (4*a* and 4*b* in FIG. 3) and the cathodes extend below the tubes 6 by the distance d.

From FIGS. 4 and 5 it will be apparent that the perforations or bores 7*a* or 7*b* in the tubes or pipes 6*a* or 6*b* (equivalent to tube 6) can be horizontally oriented or upwardly inclined, the tube being composed of rigid polyvinylchloride and being connected by the clips 12 along the lower edge of the respective plate 1*a*, 1*b*.

We claim:

1. An anode for the electrodeposition of a nonferrous metal from solution in an electrolyte and adapted to be disposed in an upright position in an electrodeposition cell, said anode comprising:

a hanger;

a conductive plate suspended from said hanger and adapted to form an anode surface, said plate having a lower edge;

a gas-permeable tube removably fixed along the lower edge of said plate and extending over the entire length of said lower edge; and a gas feeder fixed along an upright edge of said plate while extending the full height thereof and communicating with said tube for delivering a gas under pressure thereto, said plate, tube and gas feeder forming a unit suspended from said hanger.

2. The anode defined in claim 1 wherein said tube is provided with perforations for discharging said gas.

3. The anode defined in claim 1 wherein said gas feeder includes a bar extending along said upright edge of said plate and formed with a socket fitting receiving said tube.

4. A cell for the electrodeposition of a nonferrous metal, comprising:

a vessel adapted to receive an electrolyte containing the nonferrous metal in solution;

a plurality of mutually parallel spaced apart cathodes vertically disposed in said vessel and immersed in said electrolyte;

a plurality of anodes disposed between said cathodes, each of said anodes comprising:

a respective hanger supporting the respective anode in said electrolyte, a respective rectangular vertical plate suspended from the respective hanger and confronting a pair of said cathodes, said plate having a pair of vertical edges and a horizontal lower edge, a perforated tube running along the entire length of the lower edge of the respective plate, a pair of supported bars extending along said vertical edges of each plate and secured to opposite ends of said tube, one of said bars being formed with a gas feeder communicating with said tube, said gas feeder communicating with a passage formed in the respective hanger and terminating at an end thereof, and a respective quick-connect coupling at said end of each hanger, said cathodes extending below said tube; and a gas-supply manifold pipe extending transverse to said anodes and detachably connectable to said couplings for supplying gas under pressure to said tubes.

5. The cell defined in claim 4 wherein said bars include electrically insulating bar elements flanking each plate along the respective vertical edges and spacing each plate from the confronting cathodes.

6. An anode for the electrodeposition of a nonferrous metal from solution in an electrolyte and adapted to be disposed in an upright position in an electrodeposition cell, said anode comprising:

(a) a conductive plate adapted to form an anode surface, said plate having a lower edge;

(b) a perforated, gas-permeable tube removably fixed along the lower edge of said plate and extending over the entire length of the lower edge;

(c) a gas feeder fixed along an upright edge of said plate and communicating with said gas-permeable tube for delivering a gas under pressure thereto;

(d) a hanger bar extending along an upper edge of said plate and provided at one end with a passage communicating with said feeder and formed with a quick connect coupling for detachable connection to a gas-supply conduit; and (e) a pair of bar members flanking said plate along its upright edges and composed of electrically nonconductive material, and means including said bar elements securing said feeder to said plate wherein one of said bars is formed with a socket fitting receiving said tube.

7. The anode defined in claim 6 wherein said bar elements are formed with holders for said tube.

8. The anode defined in claim 6 wherein said bar elements are of a thickness dimensioned to enable them to act as spacers between the anode and cathodes of a cell confronting said anode.

9. The anode defined in claim 6 wherein said perforations extend horizontally.

10. The anode defined in claim 6 wherein said perforations ar upwardly inclined.

* * * * *